United States Patent [19]

VanDomelen

[11] Patent Number: 4,857,000

[45] Date of Patent: Aug. 15, 1989

[54] CIRCUIT BOARD EJECTOR/GUIDE

[75] Inventor: Joseph D. VanDomelen, Aloha, Oreg.

[73] Assignee: Tektronix, Inc., Beaverton, Oreg.

[21] Appl. No.: 156,055

[22] Filed: Feb. 16, 1988

[51] Int. Cl.[4] ..... H01R 9/09; H01R 13/64

[52] U.S. Cl. ..... 439/64; 439/160; 439/377; 439/59

[58] Field of Search ..... 439/59, 64, 152, 153, 439/157, 160, 324, 377

[56] References Cited

U.S. PATENT DOCUMENTS

| | | | |
|---|---|---|---|
| 3,784,954 | 1/1974 | Grimm et al. | 439/160 |
| 3,853,379 | 12/1974 | Goodman et al. | 439/377 |
| 4,345,809 | 8/1982 | Sugden | 439/160 |
| 4,511,199 | 4/1985 | Erlam et al. | 439/160 |
| 4,530,615 | 7/1985 | Katsmuura et al. | 439/160 |
| 4,579,408 | 4/1986 | Sasaki | 439/153 |

FOREIGN PATENT DOCUMENTS

| | | | |
|---|---|---|---|
| 0758329 | 8/1980 | U.S.S.R. | 439/377 |

*Primary Examiner*—P. Austin Bradley
*Attorney, Agent, or Firm*—Francis I. Gray

[57] ABSTRACT

A circuit board ejector/guide has an ejector end and an integral guide end. The ejector end has a first bearing surface and the guide end adjacent the ejector end has a second bearing surface. The ejector end has means for pivotally mounting the circuit board ejector/guide on an extender circuit board so that the first bearing surface is used to remove the extender circuit board from a housing when the circuit board ejector/guide is in a stored position. The guide end includes guide rails for holding a circuit board to be tested when in an open position, and the second bearing surface is used to remove the extender circuit board from the housing when in the open position.

7 Claims, 3 Drawing Sheets

CIRCUIT BOARD EJECTOR/GUIDE

BACKGROUND OF THE INVENTION

The present invention relates to circuit board accessories, and more particularly to a circuit board combination ejector and guide for attachment to an extender circuit board to provide a secure connection between the extender circuit board and an equipment circuit board.

In the testing of electronic equipment, circuit boards may be tested independently at a test bench, but preferably are tested in situ, i.e., while still installed in the equipment. To test the circuit boards in situ requires some means of making the circuit boards accessible. Accessibility is obtained by removing the circuit board to be tested and by replacing it with an extender board that provides extender connectors at an outer edge and circuit connectors at an inner edge for connection to corresponding equipment connectors. Electrical connections are provided between the inner edge connectors and the extender connectors so that the extender connectors are equivalent to the equipment connectors. The circuit board to be tested is then connected to the extender connectors in lieu of the equipment connectors so that the circuit board is outside the euipment while still being electrically in situ, thus making all testing points on the circuit board readily accessible.

The circuit board generally has some sort of ejector mechanism to assist in removing the circuit board from the equipment, and the equipment provides guides to assist in properly installing the circuit board. However when the circuit board is connected to the extender circuit board, the circuit board ejector mechanism is not functional for removing the circuit board from the extender circuit board and there are no means for guiding and holding the circuit board for assistance in installing securely the circuit board on the extender circuit board.

What is desired is a circuit board ejector/guide for attachment to an extender circuit board that assists and securely holds a circuit board to be tested when connected to the extender circuit board while providing a means for using the circuit board ejector to assist in removing the circuit board from the extender circuit board.

SUMMARY OF THE INVENTION

Accordingly the present invention provides a circuit board combination ejector and guide for attachment to an extender circuit board to assist in the installation of a circuit board to be tested on the extender circuit board and to securely hold it in place when installed while providing means for using a standard ejector attached to the circuit board to assist in removing the circuit board from the extender circuit board. The ejector/-guide has an ejector end and an integral guide end, and is pivotally attached to the extender circuit board at the ejector end. The ejector end acts as a standard circuit board ejector to remove the extender circuit board from the equipment when in a stored position. The guide end assists in removing the extender circuit board when the ejector/guide is in an open poistion, and provides a surface against which the circuit board ejector reacts to remove the circuit board from the extender circuit board. The guide end acts as an extension to circuit board guides in the equipment when the ejector/guide is in the open position to hold the circuit board securely when connected to the extender circuit board.

The objects, advantages and other novel features of the present invention are apparent from the following detailed description when read in conjunction with the appended claims and attached drawing.

DESCRIPTION OF THE PREFERRED EMBODIMENT

Figure 1:
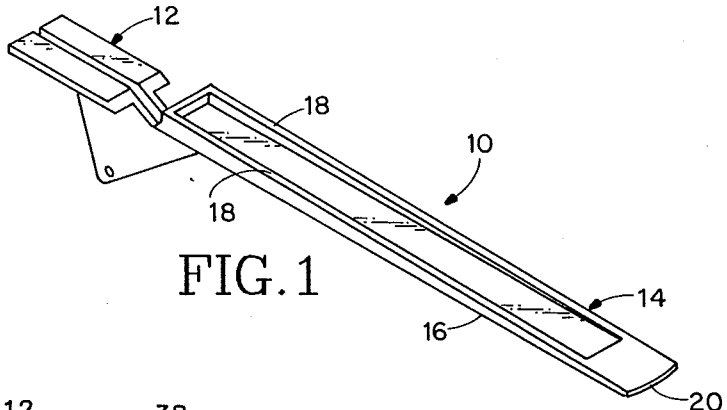
FIG. 1 is a perspective view of a circuit board ejector/guide according to the present invention.
Figure 3:
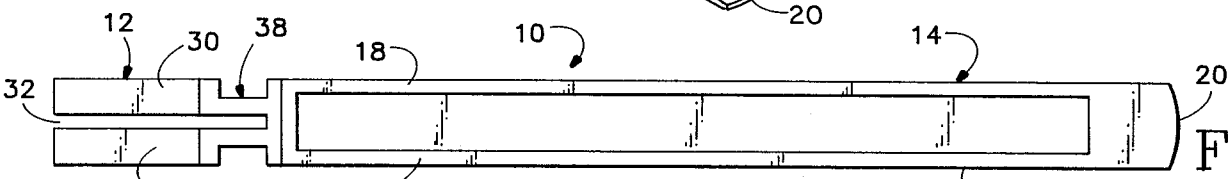
FIG. 3 is a top plan view of the circuit board ejector/guide of FIG. 1.
Figure 4:
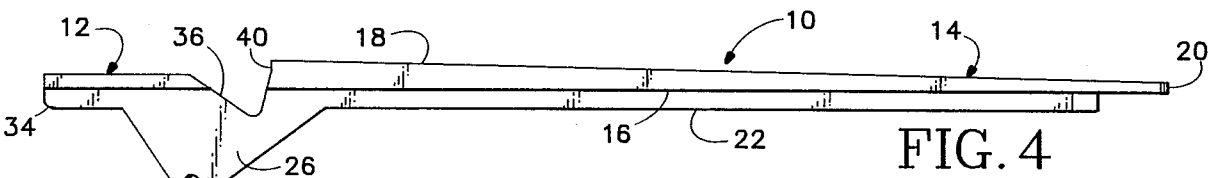
FIG. 4 is a side plan view of the circuit board ejector/guide of FIG. 1.
Figure 5:
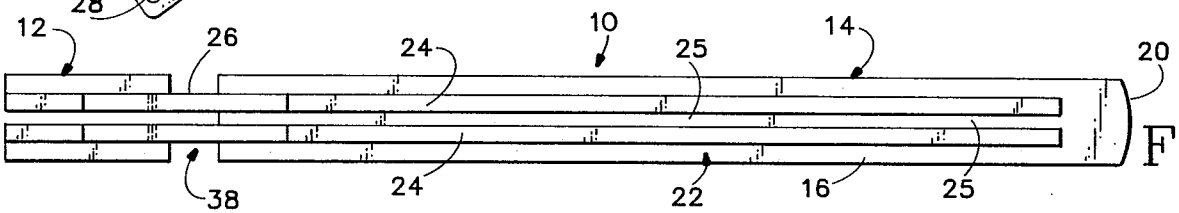
FIG. 5 is a bottom plan view of the circuit board ejector/guide of FIG. 1.
Figure 2:
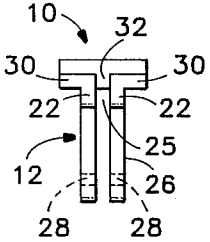
FIG. 2 is an end plan view of the circuit board ejector/guide of FIG. 1.

Referring now to FIGS. 1-5 a circuit board ejector/-guide 10 according to the present invention is shown. The circuit board ejector/guide 10 has an ejector end 12 and a guide end 14, the guide end being integral with the ejector end. The guide end 14 has an elongate body 16 having a rectilinear cross-section. Integral with the elongate body 16 are reinforcing ribs 18 which extend from close to an extreme end 20 toward the ejector end 12 along the length of the elongate body, the ribs tapering down from the ejector end to the extreme end. On the opposite side of and integral with the elongate body 16 from the ribs 18 is a circuit board guide 22 which extends from near the extreme end 20 through the ejector end 12 in the form of two parallel rails 24 with a gap 25 between them. The rails 24 have a lobe 26 at the ejector end 12 with a through hole 28 having an axis perpendicular to the rails.

The ejector end 12 has an ejector body 30 with a slot 32 along its length aligned with the gap 25 between the rails 24, the ejector body being an extension of the elongate body 16. The ejector body 30 is integral with the rails 24. The end of the rails 24 at the ejector end 12 forms a first bearing surface 34. A notch 36 between the ejector end 12 and the guide end 14 forms a neck region 38 between the two ends which separates the ejector body 30 from the elongagte body 16. The end of the elongate body 16 closest to the ejector end at the notch 36 forms a second bearing surface 40.

Figure 6:
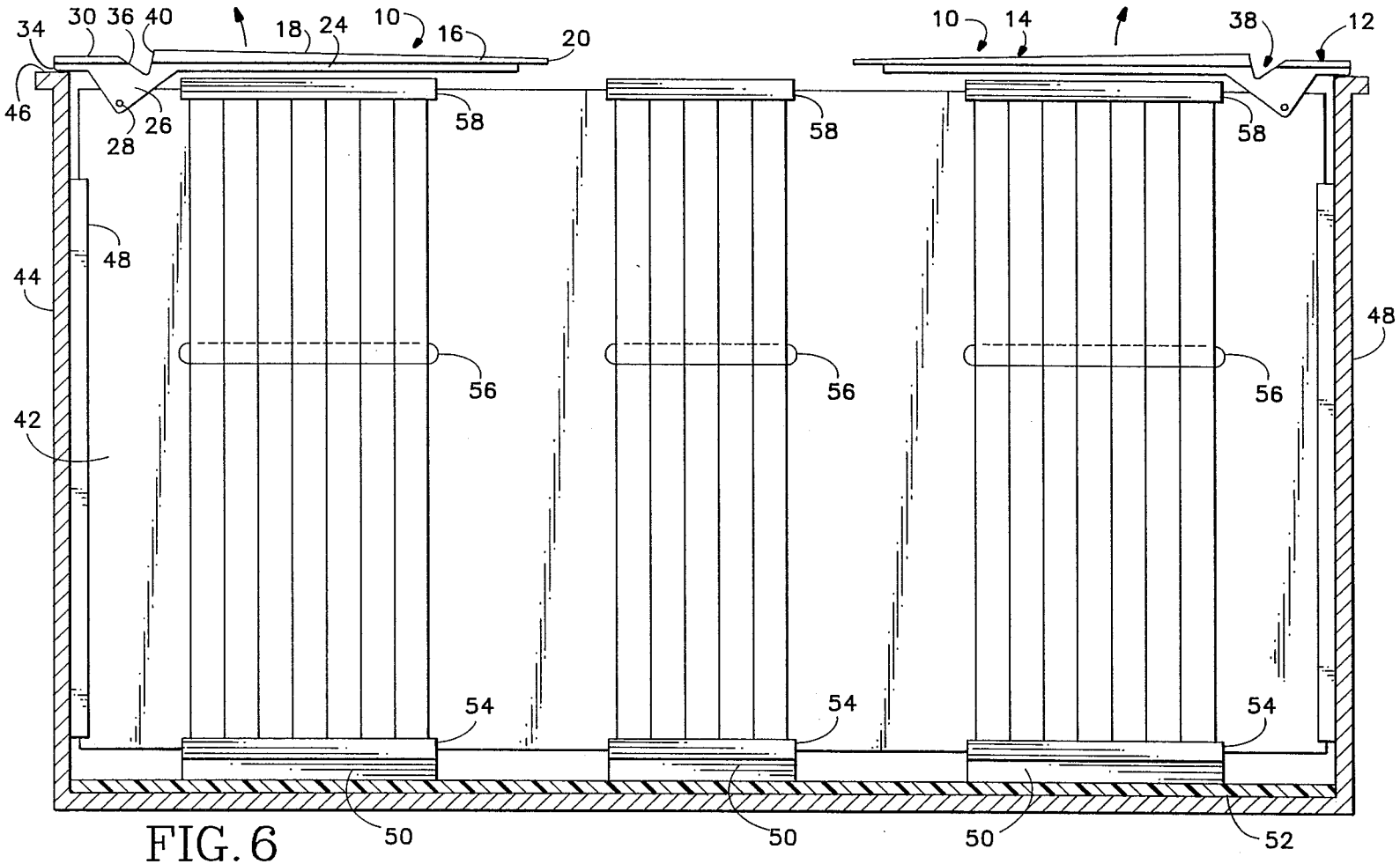
FIG. 6 is a cutaway view of an equipment closure showing an extender circuit board having circuit board ejector/guides in a stored position according to the present invention.
Figure 7:
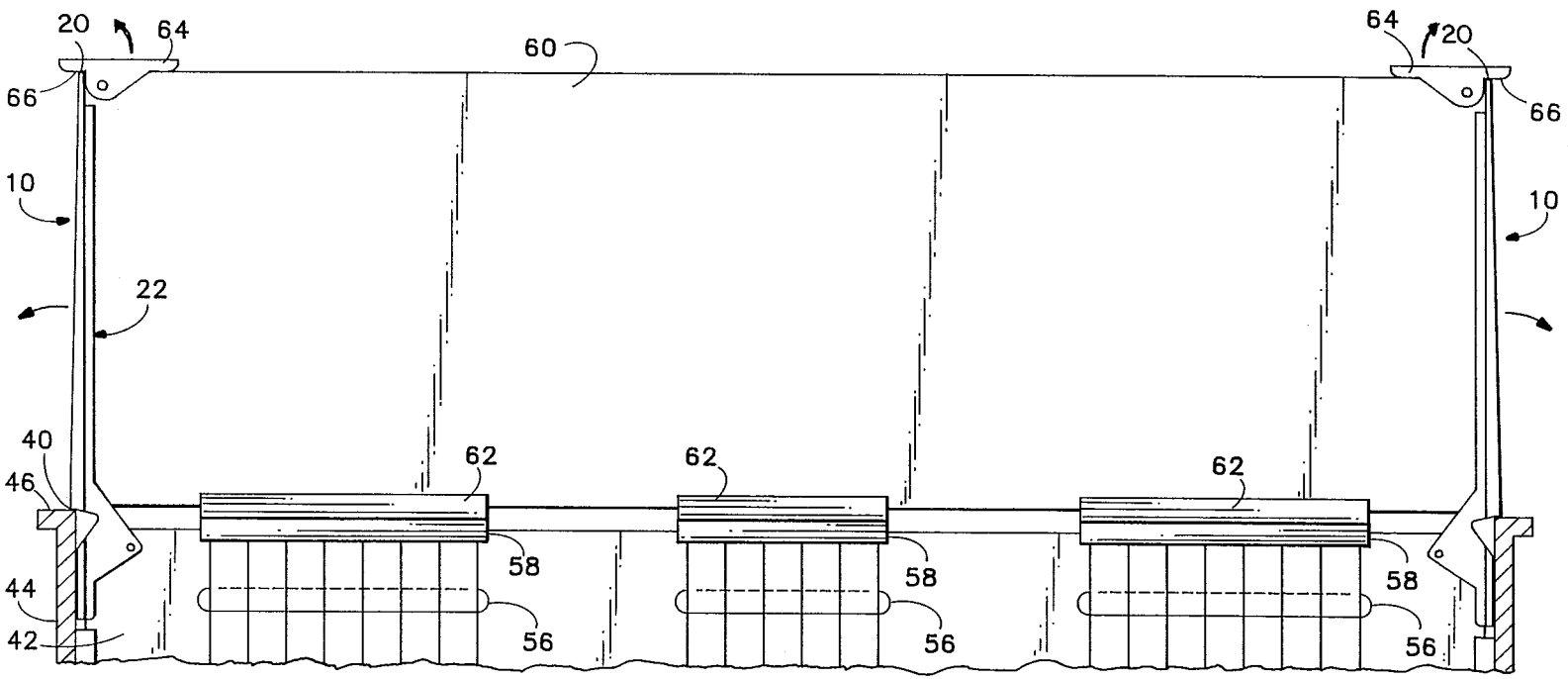
FIG. 7 is a cutaway view as in FIG. 6 showing a circuit board to be tested held by the circuit board ejector/guides in an open position according to the present invention.

The ejector/guide 10 is pivotally mounted on an edge of an extender circuit board 42 near a side, as shown in FIGS. 6 and 7, so that, when the extender circuit board is inserted into a housing 44 and the ejector/guide is in a stored position, the first bearing surface 34 rests on an upper surface or lip 46 of the housing and the guide end 16 extends inwardly of the housing along the edge of the extender circuit board. A pin, rivet or the like is extended through the through holes 28 and a similar through hole in the extender circuit board 42 with the lobs 26 straddling the edge of the extender circuit board so that the ejector/guide 10 can pivot about such pin, rivet or the like wth respect to the extender circuit board. The extender circuit board 42 is mounted in the housing 44 as a regular circuit board, being retained in place by circuit board guides 48 along the wall of the housing and being electrically connected to housing connectors 50 mounted on an electrical base circuit board 52. Alternatively the extender circuit board 42 is mounted in a storage slot with no connectors, the presence of the storage slot depending upon the amount of room within the instrument. Extender base connectors 54 electrically interact with the housing connectors 50, and circuit leads 56 mounted on the extender circuit board 42 electrically connect the extender base connectors to extender connectors 58 mounted along the top edge of the extender circuit board in a configuration identical to the housing connectors.

Removal of the extender circuit board 42 from the housing 44 is facilitated by lifting up on the elongate body 16 of the ejector /guide 10 which rotates the ejector/guide about the pivot point defined by the through holes 28 so as to apply force through the first bearing surface 34 against the housing lip 46, applying upward pressure to the extender circuit board as a result. Once the extender circuit board 42 is removed, it may then be reinserted into the housing 44 with the ejector/guide 10 in a vertical, or open, position such that the elongate body 16 extends parallel with the sides of the housing and the second bearing surface 50 rests on the housing lip 46. A circuit board 60 to be tested may now be inserted into the guides 22 of the ejector/guide 10 and electrically conncted to the extender connectors 58 via circuit board connectors 62. Standard ejectors 64 mounted on the top of the circuit board 60 having a bearing surface 66 which rests on the extreme ends 20 of the elongate body 16. Now the circuit board 60 is readily accessible for testing and is electrically in situ in the equipment.

To remove the circuit board 60 the standard ejectors 64 are pivoted so that the bearing surfaces 66 apply force on the extreme ends 20 of the elongate bodies 16 to lift the circuit board to break the electrical and physical connection between the circuit board connectors 62 and the extender board connectors 58. After the circuit board 60 is removed, the extender circuit board 42 may be removed by applying force outwardly of the housing 44 upon the elongate bodies 16 so that the second bearing surfaces 40 apply force to the housing lip 46 to lift the extender circuit board 42 from the housing. The ejector/guide 10 may then be returned to the stored position and the extender circuit board 42 reinserted into the housing 44, or into a vacant circuit board slot in the housing, until needed again.

Thus the present invention provides a circuit board ejector/guide that provides support to a circuit board to be tested when mounted on an extender circuit board while providing means for easily ejecting the extender board with or without the circuit board to be tested by having an ejector end with two bearing surfaces and having an integral guide end such that when in a closed position one bearing surface operates in a standard ejector manner and when in an open position to hold the circuit board to be tested the other bearing surface operates to remove the extender circuit board.

What is claimed is:

1. A circuit board ejector/guide for providing access to a circuit board to be tested comprising:

an ejector end having a first bearing surface;

a guide end integral with the ejector end and having a second bearing surface, the guide end having means for holding the circuit board; and means integral with and between the ejector and guide ends for pivotally mounting the circuit board ejector/guide on an extender circuit board so that when the circuit board ejector/guide is in a first position with respect to the extender circuit board, pivoting of the circuit board ejector/guide causes the first bearing surface to contact a housing surface to provide a lifting force to the extender circuit board, and when the circuit board ejector/guide is in a second position with respect to the extender circuit board such that the guide end is capable of holding the circuit board, pivoting of the circuit board ejector/guide causes the second bearing surface to contact the housing surface to provide the lifting force to the extender circuit board.

2. A circuit board ejector/guide as recited in claim 1 wherein the ejector end comprises an ejector body mounted on parallel, spaced apart rails and having a slot contiguous with the space between the rails to allow the ejector body to straddle the extender circuit board when the circuit board ejector/guide is pivoted, the end of the rails furthest from the guide end forming the first bearing surface.

3. A circuit board ejector/guide as recited in claim 2 wherein the pivotally mounting means comprises a lobe portion of the rails having a through hole for a pin so that, when the lobe portion of the rails straddles the extender circuit board and the pin is inserted through the through holes and a corresponding through hole in the extender circuit board, the circuit board ejector/guide is free to pivot with respect to the extender circuit board.

4. A circuit board ejector/guide as recited in claim 1 wherein the guide end comprises:

an elongate body having an extreme end and a near end, the near end integrally adjoining the ejector end and forming the second bearing surface; and a pair of parallel, spaced apart rails running the length of the elongate body on one side, the space between the rails forming a slot to hold the circuit board when the circuit board ejector/guide is in the second position.

5. A circut board ejector/guide as recited in claim 4 wherein the guide end has a sufficient length so that the extreme end forms a lip upon which a bearing surface of a circuit board ejector operates to remove the circuit board from the extender circuit board.

6. A circuit board ejector/guide as recited in claim 4 wherein the guide end further comprises a rib running for a portion of the length of the elongate body on a side opposite to the rails.

7. A circuit board ejector/guide as recited in claim 6 wherein the rib tapers from the near end to a point close to the extreme end.

* * * * *